US007043404B2

(12) United States Patent
Arzberger et al.

(10) Patent No.: US 7,043,404 B2
(45) Date of Patent: May 9, 2006

(54) METHOD AND DEVICE FOR LOCAL PROCESSING OF CASTING DATA ARISING FROM MEASUREMENT DATA OBTAINED FROM A CONTINUOUS CASTING CHILL BY MEANS OF SENSORS

(75) Inventors: Matthias Arzberger, Düsseldorf (DE); Martin Langer, Velbert (DE); Josef Deussen, Heinsberg (DE); Walter Schmalz, Erkrath (DE); Lothar Parschat, Ratingen (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 10/169,212

(22) PCT Filed: May 26, 2001

(86) PCT No.: PCT/EP01/06028

§ 371 (c)(1),
(2), (4) Date: Jun. 27, 2002

(87) PCT Pub. No.: WO01/94052

PCT Pub. Date: Dec. 13, 2001

(65) Prior Publication Data

US 2003/0014195 A1 Jan. 16, 2003

(30) Foreign Application Priority Data

Jun. 7, 2000 (DE) ..... 100 28 304

(51) Int. Cl.
*G06F 11/00* (2006.01)
*G06F 15/00* (2006.01)

(52) U.S. Cl. ..... 702/188

(58) Field of Classification Search ..... 702/188, 702/182–185, 33–36, 105
See application file for complete search history.

(56) References Cited

U.S. PATENT DOCUMENTS

| | | | | |
|---|---|---|---|---|
| 4,030,531 | A * | 6/1977 | Wunnenberg et al. | 164/454 |
| 4,075,890 | A * | 2/1978 | Iwasaki et al. | 73/295 |
| 4,126,041 | A | 11/1978 | Doi et al. | 73/295 |
| 4,884,624 | A * | 12/1989 | Pleschiutschnigg et al. | 164/454 |
| 6,241,004 | B1 * | 6/2001 | Ebisu et al. | 164/466 |

FOREIGN PATENT DOCUMENTS

| | | |
|---|---|---|
| DE | 2655640 | 10/1977 |
| DE | 3436331 | 4/1986 |
| EP | 0057627 | 8/1982 |
| FR | 1372630 | 8/1963 |
| GB | 1378158 | 12/1974 |

* cited by examiner

*Primary Examiner*—Michael Nghiem
(74) *Attorney, Agent, or Firm*—Friedrich Kueffner

(57) ABSTRACT

A method for local processing of casting data arising from measurement data obtained from a continuous casting mold by sensors. The data processing is carried out using a process control computer pertaining to the control system of the continuous casting installation. The measurement and control data is immediately collected from the continuous casting mold in cold field modules, converted to bus signals in a bus line, stored at least in the control system of the continuous casting installation, and/or processed.

14 Claims, 3 Drawing Sheets

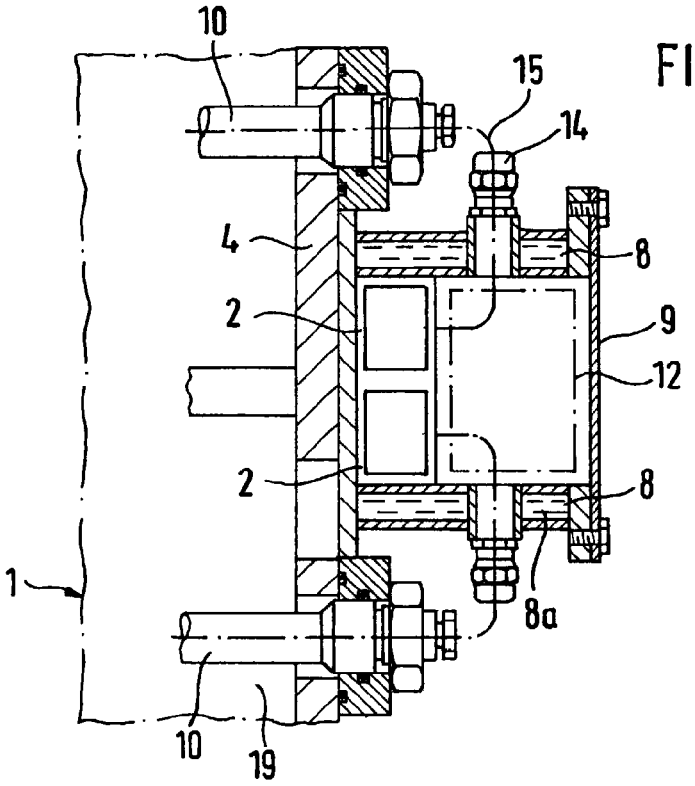
FIG.3
FIG.4
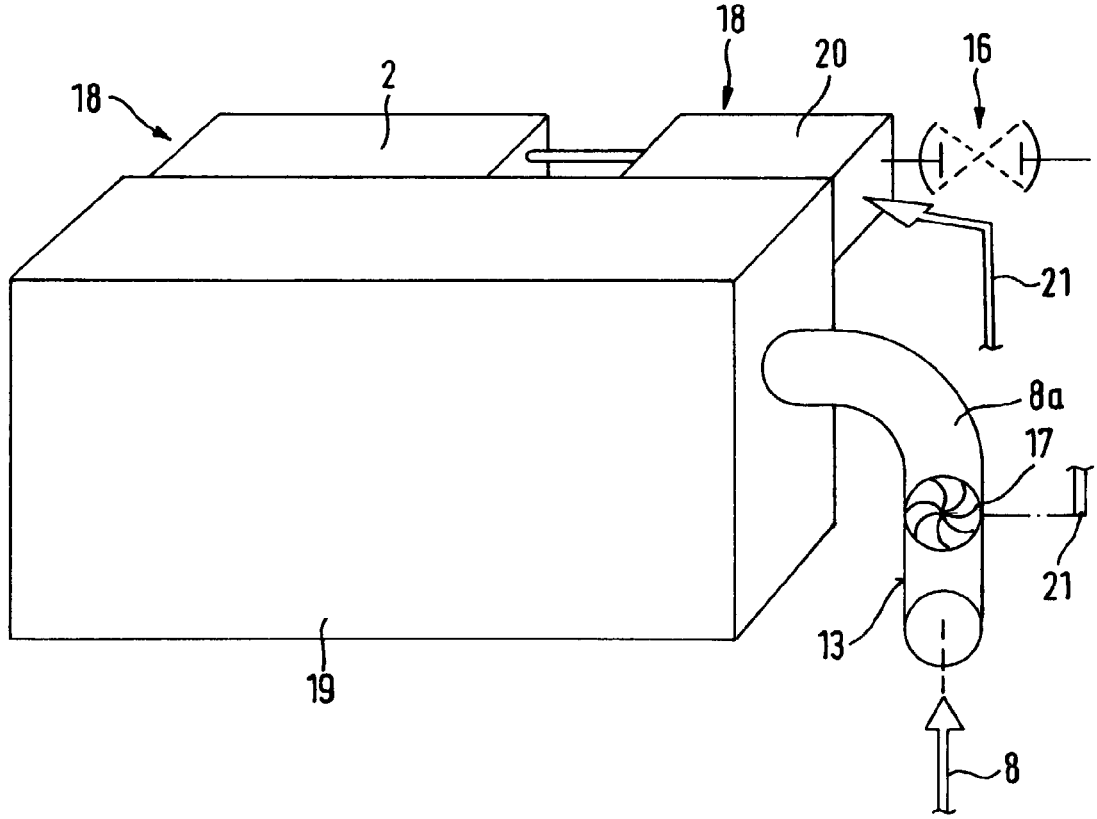

METHOD AND DEVICE FOR LOCAL PROCESSING OF CASTING DATA ARISING FROM MEASUREMENT DATA OBTAINED FROM A CONTINUOUS CASTING CHILL BY MEANS OF SENSORS

This application is a 371 of PCT/EP01/06028 filed on May 26, 2001.

BACKGROUND OF THE INVENTION

The invention pertains to a method and a device for the local processing of casting data in a process computer used to control the continuous casting installation, these data being in the form of measurement data obtained from sensors on a continuous casting mold.

In continuous casting installations, horizontal rows of thermocouples and resistance temperature detectors are mounted on the continuous casting mold. The conducting wires from these thermocouples, each with two connections, pass via terminal boxes to a so-called trunk cable. In the case where, for example, 60 thermocouples and 40 resistance temperature detectors are used, there are 240 thermal signal lines, all of which must be guided to the trunk cable.

First, these thermal signal lines pass to transducers. The trunk cable is connected by means of multicouplings (couplings and opposing couplings) to a power supply on the nonmoving part of the continuous casting installation, i.e., on so-called "solid ground", outside the oscillating continuous casting mold. All the thermal signal lines, the terminal boxes, and the trunk cable are exposed to temperatures of approximately 60–100° C. In addition to the heat, there is also the contamination attributable to splashes of slag, for example, which is an unavoidable part of the casting operation, and there is also moisture to deal with. Because the thermocouples and resistance temperature detectors operate at voltages in the range of 10–500 mV, the electromagnetic fields of other components on the continuous casting mold also have an effect. This design is associated with long replacement times, a large amount of assembly work, a large amount of installation and cabling work, high material costs, and a large amount of maintenance work for various units on the continuous casting mold (e.g., the adjusting drive for the end plates, for distance sensors, for remote stations for temperature measurement sites, etc.).

A device for determining the level of the melt in a continuous casting mold (DE-OS 2,655,640) belongs to the state of the art. This design, however, merely provides means for detachably installing a detector box in the water jacket of the continuous casting mold and for installing inlet and outlet means for the cooling water in the detector box, so that the cooling water can be guided through the detector box to cool the electromagnetic coil installed in it along with the protective housing. This solution therefore cannot be applied to the thermocouples and resistance temperature detectors mounted on the continuous casting mold. The measurement method is also configured in a different manner.

SUMMARY OF THE INVENTION

The invention is based on the task of electronically processing various types of data, including the casting data measured by sensors, in an efficient manner and thus also on the task of simplifying the system.

The imposed task is accomplished according to the invention in that the measurement and control data are collected in cooled field bus modules directly on the continuous casting mold, transferred as bus signals to a bus line, and stored and/or processed at least in the control unit of the continuous casting installation. As a result, the length of the data path is considerably reduced and simplified, and the system is also simplified, as will be explained in more detail below. Advantageous in particular is that the only connection which must be made or broken is located in a terminal box located on "solid ground", which means that replacement times are significantly decreased, installation and cabling work is reduced, material costs are lowered, maintenance work is reduced, and thus the yield of steel can be significantly increased. The data can also be processed in the field bus module itself or even via the Internet anywhere in the world. Data can be acquired from the sensors or actuators such as shaft encoders, angle sensors (so-called inclinometers), pumps, flowmeters, controllable valves, electric motors, etc.

In an elaboration of the invention, it is provided that the detected measurement data or additionally entered specific data are sent as control signals via the bus lines to adjusting elements and/or actuators in the area of the continuous casting mold. As a result, the system can also be used actively for open or closed-loop control of the casting process.

Another advantage is obtained in that mold-specific information on the thickness of the copper plates, on the degree of their wear, on the condition of the temperature sensors and/or resistance temperature detectors, and on the maintenance cycles can be stored in the field bus module on the continuous casting mold and called up again.

In a further elaboration of the invention, the exchange of data and the supply of energy are accomplished via a hybrid coupling extending at least between the field bus modules and the process computer. As a result, both data streams and energy streams can be conducted through an electrical conductor.

In a further elaboration it is provided that the hybrid coupling is formed by a communications bus and a power supply. All of the streams thus pass through a single hybrid cable.

It is also advantageous for the hybrid coupling to be operated in the presence of a coolant. The cooling water used to cool the continuous casting mold can also be used to cool the coupling. It is also possible to use a different coolant (gas or liquid) supplied from the outside.

The system for the local processing of the casting data in a process computer used to control the continuous casting installation, these data being in the form of measurements obtained from sensors installed on a continuous casting mold, accomplishes the task according to the invention in that several field bus modules connected to the sensors and/or actuators are attached directly to the continuous casting mold and are provided with cooling. As a result, all the sensors on the continuous casting mold are wired directly over a short signal path to local measurement transducers.

It is possible to choose from among several variants for cooling. According to one simple proposal, it is provided that the field bus modules are cooled by the flow of coolant which cools the continuous casting mold. This leads to a minimal amount of added expense.

According to another variant, the field bus modules are enclosed in a cooled, protective housing. In this case it is advisable for an outside cooling system to be used, which is able to exclude moisture from the supplied coolant.

In accordance with additional features, preventing the intrusion of moisture and independence from the moisture content of the air can be achieved by installing an air-conditioning unit for cooling in the protective housing.

Another improvement of the invention consists in that the communications bus is built physically out of electrical or electronic circuit technology, fiber-optic technology, or wireless transmission technology.

It is also provided that the wireless transmission technology consists of radio transmission or is based on infrared radiation.

Another elaboration of the invention provides that a generator, which supplies power to the electrically operated components attached to the continuous casting mold, can be driven by the flow of coolant in the continuous casting mold. The power input for the generator consists in the flow energy of the cooling water.

A variant of this idea consists in deriving the drive motion for the generator from the oscillations of the continuous casting mold.

BRIEF DESCRIPTION OF THE DRAWING

An exemplary embodiment of the invention is shown in greater detail in the drawing and explained below:

FIG. 3 is a side view of the mold according to FIG. 2; and

FIG. 4 is a perspective view of the water box of a continuous casting mold.

DETAILED DESCRIPTION OF THE INVENTION

Figure 1:
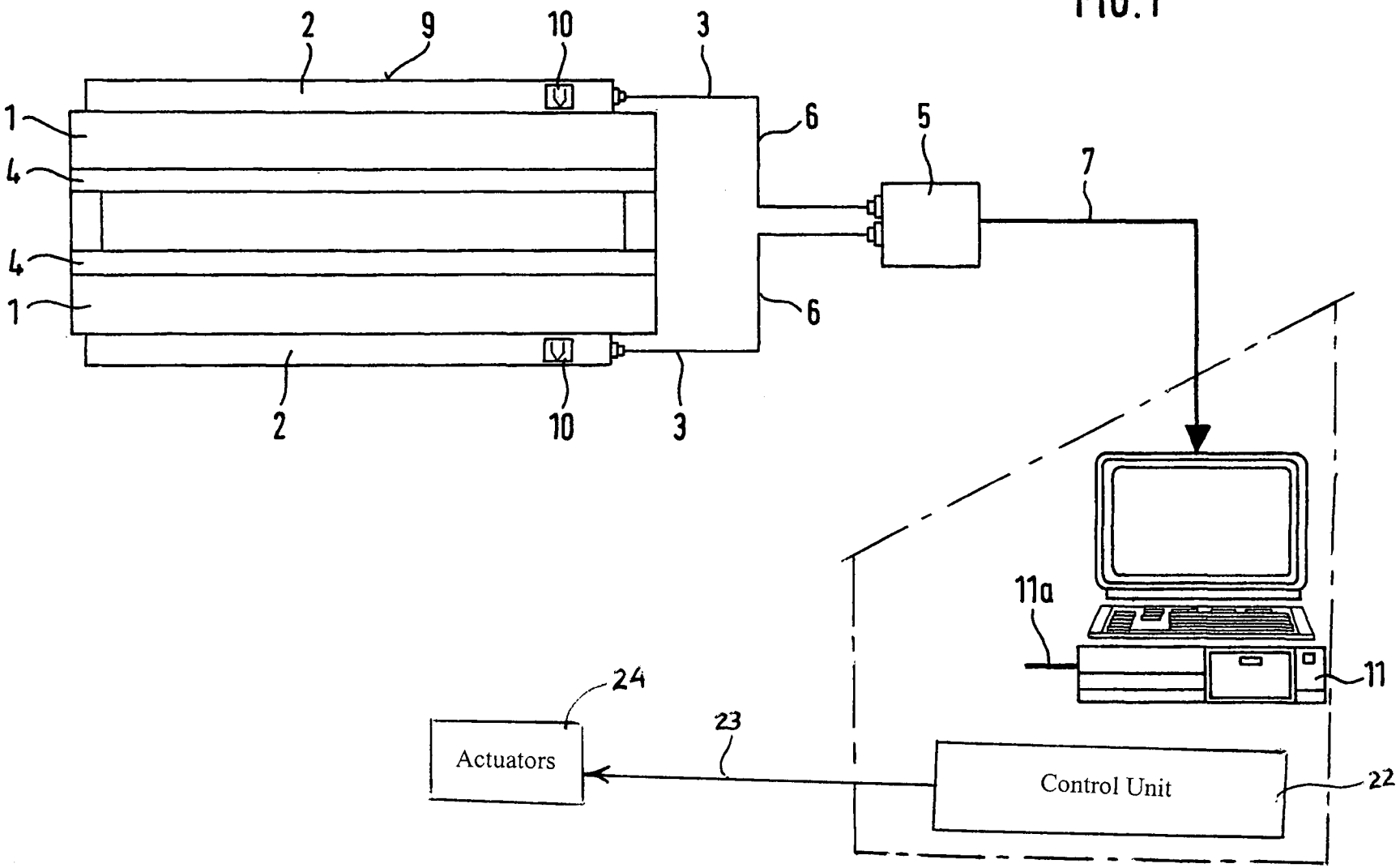
FIG. 1 is a functional block diagram of the continuous casting mold with field bus modules.

The method for the local processing of casting data in a process computer 11 with a redundancy connection 11*a* for controlling the continuous casting installation (FIG. 1), these data being in the form of measurement data obtained from temperature sensors or resistance temperature detectors 10 on a continuous casting mold 1, is implemented in such a way that the measurement data obtained from a plurality of temperature sensors and/or resistance temperature detectors 10 distributed over the continuous casting mold 1 are collected in a cooled field bus module 2 attached directly to the continuous casting mold 1, transferred as bus signals to a bus line 3, and stored and processed in the control unit 22 of the continuous casting installation. The recorded measurement data or additionally entered specific data can also be sent over the single bus line 3 and cables 23 as control signals to adjusting elements and/or actuators 24 in the area of the continuous casting mold 1. The adjusting elements can be considered to include the copper plates 4, for example, in the form of the end plates and the actuators as the associated drives. The mold-specific information pertains, for example, to the thickness of the copper plates, to their degree of wear, to the condition of the temperature sensors or of the resistance temperature detectors 10, and to the maintenance cycles.

According to FIG. 1, the data exchange over the bus lines 3 and a terminal box 5 with a transformer takes place over a hybrid coupling between the field modules 2 and the process computer. The hybrid coupling consists of a hybrid cable 6 with a communications bus 7 and a power supply. Like the field bus modules 2, the hybrid cable 6 can also be operated with cooling 8. Generally speaking, the flow of coolant 8*a* present for the continuous casting mold can be used as the cooling 8 for the field bus modules 2.

Figure 2:
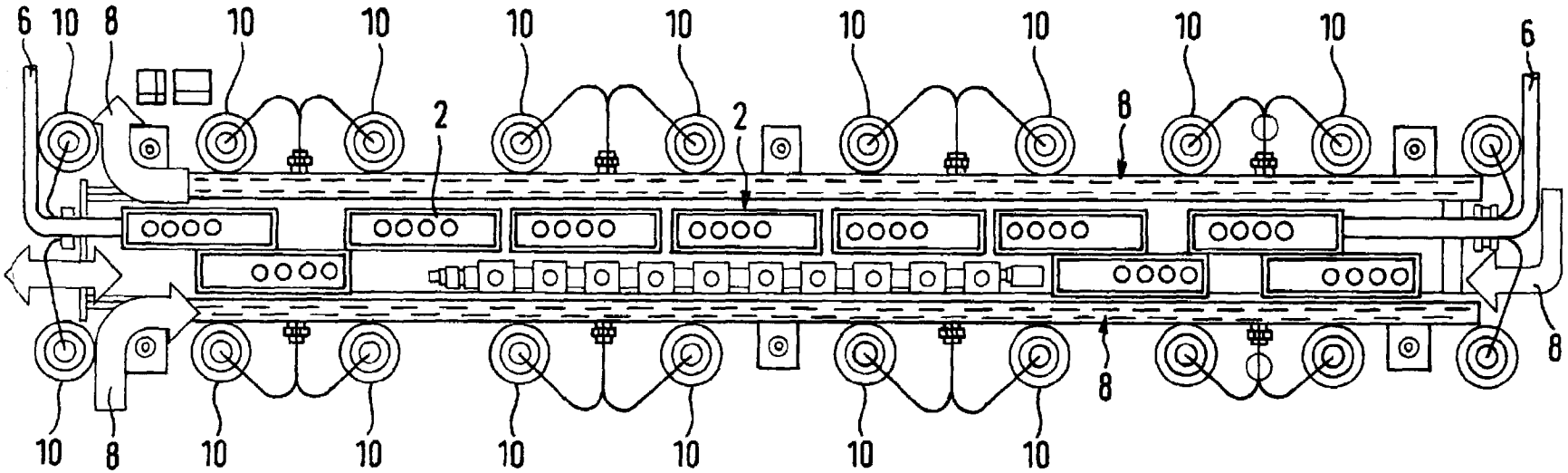
FIG. 2 is a top view of the continuous casting mold with the field bus modules.

The field bus modules 2 are surrounded by a cooled protective housing 9. In the protective housing there is, if necessary, a separate air-conditioning unit 12 (FIGS. 2 and 3). The protective housing 9 is mounted on the continuous casting mold 1 or on the water box 19, so that the field bus modules 2 are the shortest possible distance away from the temperature sensors 10 and from the coolant flow 8*a* and/or the air-conditioning unit 12. The same is true for the thermal signal lines 15, which pass through cable bushings 14 from the temperature sensors to the field bus modules 2.

According to FIG. 4, the communications bus 7 consists physically of electrical or electronic circuit technology or of fiber-optic technology or of wireless transmission technology, where the wireless transmission technology can consist of radio transmission 16 or be based on infrared radiation.

The field bus modules 2 (remote module) and a transmitter/receiver module 20 are mounted as electrically operated components 18 on the continuous casting mold 1. Inside a cooling water channel 13, a generator 17 is installed, which generates current via the coolant flow 8*a* and represents a power supply 21 for the electrically operated components 18.

The drive motion for the generator can also be derived from the oscillations of the continuous casting mold.

| List of Reference Numbers | |
|---|---|
| 1 | continuous casting mold |
| 2 | field bus module |
| 3 | bus line |
| 4 | copper plate |
| 5 | terminal box with transformer |
| 6 | hybrid cable |
| 7 | communications bus |
| 8 | cooling |
| 8a | coolant flow |
| 9 | protective housing |
| 10 | temperature sensors, resistance temperature detectors |
| 11 | process computer |
| 11a | redundancy connection |
| 12 | air-conditioning unit |
| 13 | cooling water channel |
| 14 | cable bushing |
| 15 | thermal signal line |
| 16 | radio transmission |
| 17 | generator |
| 18 | electrically operated component |
| 19 | water box |
| 20 | transmitter/receiver module |
| 21 | power supply |

The invention claimed is:

1. A method for the local processing of casting data in a process computer for the control of a continuous casting installation, these data being in the form of measurement data obtained from sensors mounted on a continuous casting mold, the method comprising the steps of: connecting the computer to the mold via the sensors; collecting the measurement and control data in cooled, enclosed electronic field bus modules directly on the continuous casting mold; transmitting the data as bus signals to a bus line; and storing and/or processing the data at least in a control unit of the continuous casting installation.

2. The method according to claim 1, wherein the recorded measurement data or additionally entered specific data are sent over the bus lines as control signals to adjusting elements and/or actuators in the area of the continuous casting mold.

3. The method according to claim 1, wherein mold-specific information on the thickness of copper plates, on their degree of wear, on the condition of the temperature sensors and/or of the resistance temperature detectors, and on the maintenance cycles are stored in recallable fashion in the field bus modules on the continuous casting mold.

4. The method according to claim 1, wherein data exchange and power supply are accomplished over a hybrid coupling at least between the field bus modules and the process computer.

5. The method according to claim 1, wherein the hybrid coupling is formed by a communications bus and a power supply.

6. The method according to claim 5, wherein the hybrid coupling is operated in the presence of a coolant.

7. A device for the local processing of casting data in a process computer for the control of a continuous casting installation, these data being in the form of measurement data obtained from sensors on a continuous casting mold, the device comprising several enclosed, electronic field bus modules (2), connected to the sensors and/or actuators, installed directly on the continuous casting mold (1) and provided with cooling (8), so that the computer is connected to the mold via the field bus modules.

8. The device according to claim 7, wherein the field bus modules (2) can be cooled by the existing coolant flow (8*a*) used to cool the continuous casting mold.

9. The device according to claim 7, wherein the field bus modules (2) are enclosed in a cooled protective housing (9).

10. The device according to claim 7, wherein an air-conditioning unit (12) for cooling is also installed in the protective housing (9).

11. The device according to claim 7, wherein the communications bus (7) is formed physically out of electrical or electronic circuit technology, fiber-optic technology, or wireless transmission technology.

12. The device according to claim 7, wherein the wireless transmission technology consists of radio transmission (16) or is based on infrared radiation.

13. The device according to claim 7, wherein a generator, which supplies power to electrically operated components (18) on the continuous casting mold (1), can be driven by the coolant flow (8*a*) in the continuous casting mold (1).

14. The device according to claim 13, wherein the drive motion for the generator (17) can be derived from the oscillations of the continuous casting mold.

* * * * *